US010113365B2

(12) United States Patent
Mumma et al.

(10) Patent No.: US 10,113,365 B2
(45) Date of Patent: Oct. 30, 2018

(54) DRILL BIT FOR MILLING COMPOSITE PLUGS

(71) Applicant: Hijet Bit LLC, Norman, OK (US)

(72) Inventors: Matthew D. Mumma, Oklahoma City, OK (US); Dustin M. Lyles, Norman, OK (US)

(73) Assignee: HIJET BIT LLC, Norman, OK (US)

( * ) Notice: Subject to any disclaimer, the term of this patent is extended or adjusted under 35 U.S.C. 154(b) by 99 days.

(21) Appl. No.: 15/043,500

(22) Filed: Feb. 12, 2016

(65) Prior Publication Data

US 2017/0234074 A1 Aug. 17, 2017

(51) Int. Cl.

| | |
|---|---|
| ***E21B 10/52*** | (2006.01) |
| ***E21B 10/16*** | (2006.01) |
| ***E21B 29/00*** | (2006.01) |

(52) U.S. Cl.

CPC ..... *E21B 10/16* (2013.01); *E21B 10/52* (2013.01); *E21B 29/00* (2013.01)

(58) Field of Classification Search

CPC ..... E21B 10/16; E21B 10/52; E21B 29/00
USPC ..... 166/376
See application file for complete search history.

(56) References Cited

U.S. PATENT DOCUMENTS

| | | | | |
|---|---|---|---|---|
| 3,126,067 | A * | 3/1964 | Schumacher | E21B 10/16 175/374 |
| 3,401,759 | A | 9/1968 | White | |
| 4,940,099 | A * | 7/1990 | Deane | E21B 10/16 175/374 |
| 5,131,480 | A * | 7/1992 | Lockstedt | E21B 10/16 175/374 |
| 5,979,575 | A | 11/1999 | Overstreet | |
| 2014/0138161 | A1 | 5/2014 | Vo et al. | |
| 2015/0053433 | A1 | 2/2015 | Kovach et al. | |

OTHER PUBLICATIONS

International Search Report and Written Opinion, Patent Cooperation Treaty, International Application No. PCT/US17/17575, dated Apr. 25, 2017, 8 pages.

* cited by examiner

*Primary Examiner* — Taras P Bemko
(74) *Attorney, Agent, or Firm* — Hubbard Johnston, PLLC

(57) ABSTRACT

A roller cone drill bit having at least one roller cone cutter, the roller cone cutter having multiple rows of cutting elements, arranged concentrically around the axis of rotation of the roller cone. One row of cutting elements is located on the heel of the roller cone. Each of the rows of cutting elements includes both cemented tungsten carbide inserts and milled teeth as cutting elements.

18 Claims, 2 Drawing Sheets

DRILL BIT FOR MILLING COMPOSITE PLUGS

FIELD OF INVENTION

The invention relates to drill bits for milling plugs set downhole in oil and gas wells.

BACKGROUND

A number of different types of plugs are used in well completion and stimulation operations to block fluid flow within well bores. Examples include bridge plugs and so-called "frac plugs," which are specially designed to isolate one or more zones of a well bore during multi-zone hydraulic fracturing operations. Once fracturing is complete, plugs are removed, often by lowering a drill bit on a string of jointed pipe or coiled tubing into the well bore to mill out the plug into small pieces for circulation to the surface with drilling fluid.

A typical plug has one or more packing elements that encircle the body of the tool to form a hydraulic seal between the body of the tool and the casing or well bore. The packing elements have a diameter small enough to lower into a well bore, but are expandable, once lowered, to engage and to create a seal between the plug and a wall of a casing, liner or open wellbore. The packing elements are typically made of an elastomer that is squeezed during the setting operation to expand them, though inflatable packing elements can also be used. During a setting operation the packing elements is squeezed, causing it to expand outwardly against the wall of the well bore. To prevent the plug from moving, elements called slips, which are located along the outer diameter of tool, are pushed outwardly to engage the wall of the well casing or liner during setting operation. The slips dig into the well casing to anchor the plug within the well bore.

Plugs will often be made of cast iron and other easily drillable materials so that they may be more easily drilled than if formed of steel. So-called "composite plugs" have been developed to make it easier to mill plugs. Most of the components in a composite plug are made of composite materials or plastic rather than metal. However, composite materials are not suitable for all elements of a plug. For example, slips must typically be made of metal or ceramics, and sometimes include tungsten carbide elements to enhance performance.

Different types of rock bits have been used to mill plugs. The most commonly used drill bit type is the roller cone bit. Roller cone bits have one to four rolling cutters with cutting elements that protrude from or are disposed on the surface of the cutters. Under the weight of a drill string, the cutting elements penetrate and gouge the plug. Each rolling cutter is in the form of a cone mounted for rotation on a journal that extends from a leg that is part of the body of the drill bit at an angle that is oblique to the central axis of the drill bit. Rotating the drill bit causes the cutters to roll along a surface of the object or material being drilled. The cutting elements are usually arranged on each cone in a rows around the cone, each row being concentric with, and forming a circle or ring around, the axis of rotation of the cone. Each of the cones will typically have two or more rows of cutting elements. The outermost row of cutting elements on a roller cone cutter, nearest the outer diameter of the drill bit, is sometimes called the "heel" row. The heel row is disposed on a heel portion of the roller cone, where the conical surface of the roller cone transitions to its base. The cutting elements on the heel row cut to the gage, or outer diameter, of the bit. The base of the roller cone typically flat, but may have a beveled surface adjacent to the heel that faces the side wall of the bore, on which can be mounted inserts that act as bearing surfaces against the side wall to keep the bit straight as it is turning, as well as maintain a gauged hole. In a bit with multiple roller cones, each cone will typically have a heel row and one or more inner rows.

A number of different types of cutting elements are used on cutters of roller cone drill bits. Generally, cutting elements used to mill plugs are either (a) milled or steel teeth and (b) cemented metal carbide inserts. Generally speaking, milled teeth are better at drilling softer material and metal carbide inserts are more durable and thus better for drilling harder material.

A milled or steel tooth is made of a steel and has a generally triangular shape. Milled teeth are usually milled from the same block of steel as the roller cone. A milled tooth may be "hardfaced" with material having greater wear resistance, such as tungsten carbide particles in a metal matrix welded to the tooth, to improve wear and make the teeth more durable. A reference to milled tooth is intended to reference either a conventional or a hard faced milled tooth unless otherwise stated. Milled teeth can be made relatively long and narrow. This sharp shape allows for more aggressive gouging and scraping actions to penetrate more rapidly softer materials with low compressive strengths.

A cemented metal carbide insert is comprised of metal carbide particles cemented together with a more ductile metal binder using a sintering process to form a composite of metal carbide grains, which are typically tungsten carbide but can be other metal carbides, embedded in and metallurgically bonded to the ductile metal matrix (also called a binder phase.) Such inserts are formed into shapes and polished very smooth to reduce sliding friction. The inserts may incorporate polycrystalline diamond and similar materials, such as a wear layer, to improve wear resistance. References throughout to "cemented metal carbide inserts" include those incorporating polycrystalline diamond, cubic boron nitride and materials of similarly high abrasions resistance. Furthermore, cemented metal carbide is one type of super hard, abrasion resistant materials. References to "insert" or an insert made of "super hard material" is intended to include inserts made of cemented metal carbide, such as tungsten carbide, but also materials of similar abrasion resistance, as well as those that have substantially better abrasion resistance.

An insert is pressed into a pocket into an aperture in the roller cone body. An interference fit between the insert and the pocket may be relied upon retain the inset in the pocket. The insert may, instead, be brazed into the pocket. The insert has cylindrical portion or base, part of which is inserted into the pocket formed in the cone, and a cutting tip portion. The cutting tip portion can be formed in one of many different shapes. Conventional shapes include chisel and hemispherical or conical.

Tungsten carbide inserts are more durable than hard faced milled teeth when milling slips made of metal or other hard materials. However, as compared to milled teeth bits, bits using tungsten carbide cutters are less efficient at milling softer materials such as elastomers and composites. Further, inserts are more likely to be lost when milling plugs due to junk damage, cone shell erosion, and problems with retaining the inserts in the pockets formed in the roller cone.

U.S. patent application no. 2015/0053422 describes a rotary cone drill bit for milling plugs that purports to drill relatively harder material of a slip disposed on an outer diameter of the plug by cutter inserts disposed on an outer diameter of the bit, while the relatively softer material of the plug body is effectively drilled out by milled teeth disposed radially inward of the cutter inserts.

SUMMARY

In a representative example of roller cone drill bit embodying teachings of the invention, the rotary cone drill bit has at least one rotary cone cutter having disposed on it at least one row of cutting elements, arranged concentrically around its axis of rotation, comprised of at least one insert of super hard material, such as a cemented metal carbide, and at least one milled teeth made of steel or other metal.

In one embodiment, at least one row of cutting elements having both inserts and milled teeth as cutting elements is a heel row. Plug designs incorporate materials that are relatively softer than metal, such as elastomers and composites, throughout the length of the plug, including inside of the plug as well as along its outer diameter where slips are located. The slip sections of the plug typically make up only a small portion of the overall length of the plug. Using only inserts made of a super hard material, such as metal carbide, on the heel row of the roller cone drill does not provide optimal milling efficiency because the most efficient cutting elements are not being used while milling most of the length of the plug. Alternating metal carbide inserts and milled teeth on the outermost row of a rolling cone cutter substantially improves overall efficiency when milling the outer diameter of the plug along is entire length, without unduly compromising the durability of the roller cone.

In another embodiment, the row of cutting elements comprising both inserts and milled teeth is located on an inner portion of the roller cone. Although slips are housed on the outer diameter of a plug, they move about the bottom of the hole and come in contact with the inner cutting elements of the roller cone cutter once they have broken free from their housing. In addition, cast iron "kill plugs" do not have a through bore; the inner cutting elements, therefore, have constant contact with cast iron when milling kill plugs. Milled teeth on inner rows of cutting elements on a roller cone are therefore susceptible to damage. On the other hand, having only metal carbide inserts in the inner rows would not only result in less efficient milling, but also leave the bit vulnerable to losing inserts due to cone shell erosion, thermal expansion, and junk damage. Alternating metal carbide and milled teeth cutting elements on an inner row of a roller cone cutter provides milling efficiency with the added durability. Metal carbide inserts on the inner rows with the milled teeth reduce damage to milled teeth when metal parts of the plug, such as the slips, are encountered, and the milled teeth increase the efficiency of the bit when engaging softer, non-metal portions of the plug.

DETAILED DESCRIPTION OF EXEMPLARY EMBODIMENTS

In the following description, like numbers refer to like elements.

Figure 1:
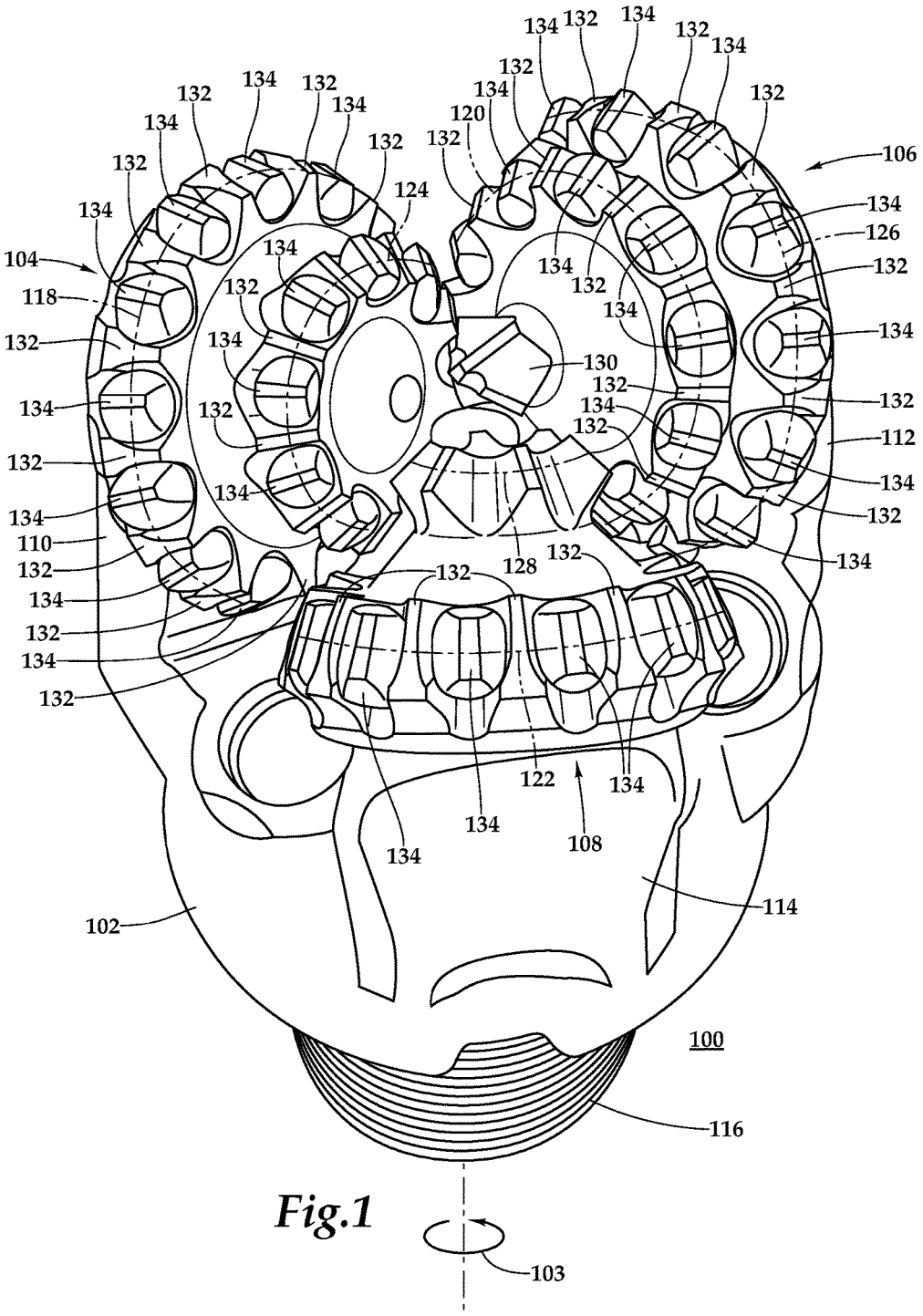
FIG. 1 is a perspective view of a representative example of roller cone drill bit.

FIG. 1 illustrates is a non-limiting, representative example of a roller cone drill bit. Roller cone drill bit 100 is suitable for drilling or milling plugs that have been set downhole in an oil or gas well. Drill bit 100 is comprised of a body 102 that has a central axis 103 (also its vertical center line) about which it is turned or rotated when connected to a drill sting (not shown) by thread pin 116 and lowered into a well bore for milling a previously set put. The body is, in this example, made of steel. However, it could be made of other materials. Furthermore, various portions of the steel body can be hard faced.

The illustrated, representative roller cone drill bit 100 has three roller cones 104, 106, and 108. However, the subject matter described below, in its broadest sense, is not limited to drill bits having any particular number of roller cones, though certain aspects of the disclosed subject matter may have advantages when used on bits with two or more roller cones. Each roller cone is mounted for rotation on a leg extends from a leg that extends from body 102 of the bit. Each leg supports a bearing (not visible) or journal on which the roller cone rotates. Roller cone 104 is mounted to leg 110. Leg 112 supports roller cone 106. And leg 114 supports roller cone 108. The angle of the axis of rotation of each of the roller cones (and the axis for rotation of the bearings) to the central axis 103 of the drill bit, which is called the journal angle, is oblique to the central axis 103. The journal angle is typically between 30 and 40 degrees. The axis of rotation of each of the roller cones is also typically offset, meaning it does not intersect with the central axis 103 about which the bit rotates.

Each of the roller cones has disposed or formed on its exterior surface at least two rows of cutting elements. Each row may also be referred to as a "cutter" in the following description. Each cutter is formed by plurality of cutting elements arranged in a row to form a circle of cutting elements surrounding the axis of the roller cone. Generally speaking, the axis of the roller cone is normal to the plane defined by the ring formed by the row of cutting elements. Each of the rows of concentric cutting elements are indicated by dashed lines 118, 120, 122, 124, 126, 128, and 130 in the figure. The dashed lines are intended only to indicate generally the location of the cutters on the roller cones formed by the rows.

In this example, each of the roller cones 104, 106 and 108 has one row of cutting elements located on or near the heel of the roller cone, which are designed by references numbers 118, 126, and 122, respectively. Depending on the particular type of rotary drill bit, this row might be referred to as a gage or heel row. These outers rows are located near the outmost diameter of the roller cone, next to the gage of the drill bit, where they are expected to encounter slips composite plugs during milling. The second row of cutting elements on each the respective roller cones is located interior of the heel row. The heel row of cutting elements establishes the outer diameter or gage of the cutting profile of the bit 100. In this example, there are three inner rows and a spear point. Middle row 124 is located on roller cone 104, middle row 120 is located on roller cone 106, and nose row 128 is located on the nose of roller cone 108. Roller cone 106 has extending from its nose a spear point 130. In this particularly representative example of a roller cone drill bit, the inner rows occupy different positions within the bit's cutting profile. In other words, unlike the heel rows, each inner row, where it engages the plug is located at a different radial distance from the centerline or central axis 103 of the bit. The spear point 130 is the innermost row. The next most inner row is row 128, then row 124, and finally row 120.

In the representative example illustrated in FIG. 1 each heel row 118, 126, and 122 is comprised of two generic types of cutting elements: milled teeth 132, made of steel in this example, and cemented metal carbide inserts (e.g. tungsten carbide inserts) 134. Alternatively, the inserts may be comprised of another type of super hard material. In the representative example the milled teeth and the tungsten carbide inserts alternate along the row. Every other cutting element is a milled tooth. Similarly, every other cutting element is a tungsten carbide insert.

One or more inner rows may also be comprised of mixed generic types of cutting elements, particularly milled teeth and inserts made of super hard material. In the illustrated bit example, middle rows 124 and 126 are comprised of alternating milled teeth 132 and cemented carbide inserts 134, but not the spear point 130 or the inner row 128. Inner row 128, the nose row, is comprised only of one type of cutting element, which, in this example, is a milled tooth. The spear point 130 is formed from steel.

In each of the rows of cutting elements shown in FIG. 1 having a mixed generic types of cutting elements of milled teeth and inserts of super hard material, the depth of the cutting profile of each of the milled teeth and each of inserts of super hard material are the same. Alternatively, however, the depth can be different, with one generic type cutting element having a deeper cutting profile than the other generic type of cutting element.

Figure 2A:
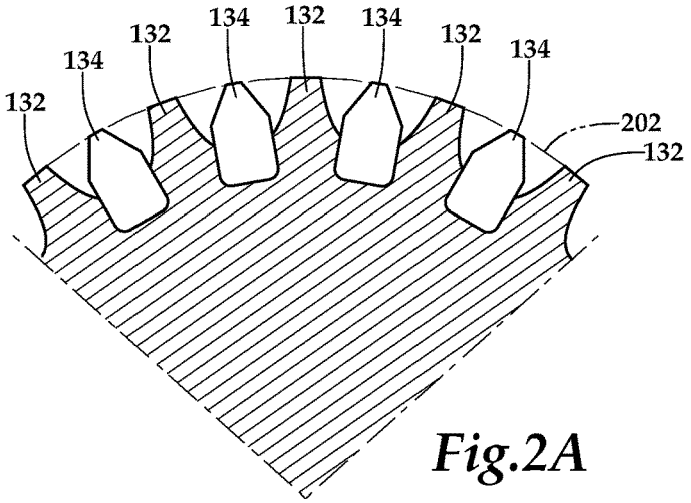
FIG. 2A is a schematic representation of a cross-sectional, side view of one embodiment of a row cutting elements on a roller cone of a drill bit.

FIG. 2A is a cross-section of a simplified or schematic nature taken through one of the heel rows 120, 126 or 118, on one of the roller cones 104, 106 or 108 of FIG. 1. The plane of the cross-section is normal to the journal axis of the roller cone. This section assumes that the cutting elements are aligned along the row. In the section of FIG. 2A the tops of the milled teeth 132 are the same distance from the journal axis as the tops of the cemented metal carbide insert, as indicated by line 202. The depth of cut of a particular cutting element, as reflected by the cutting profile of the bit (not illustrated), could be affected by other facts, such as shape of the particular cutting element and its location (as measured by its radial distance from the centerline of the bit). FIG. 2A is indicated to illustrate an embodiment in which the two different types of cutting elements have similar exposures.

Figure 2B:
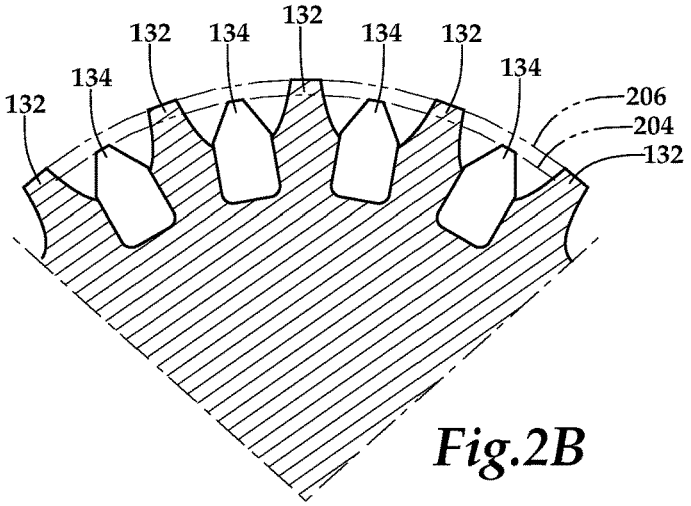
FIG. 2B is a schematic representation of a cross-sectional, side view of an alternative embodiment of a row cutting elements on a roller cone of a drill bit.
Figure 2C:
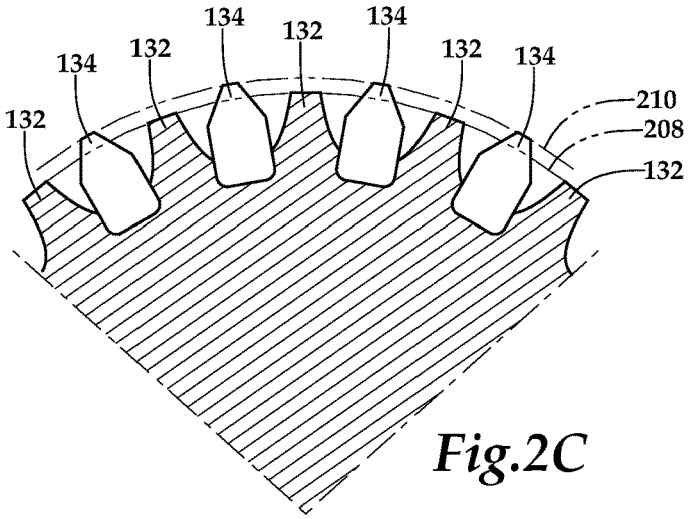
FIG. 2C is a schematic representation of a cross-sectional, side view of another alternative embodiment of a row cutting elements on a roller cone of a drill bit.

However, for a particular row of mixed cutting elements in an alternating pattern on a particular cone, it can be advantageous for cutting elements of a first type be made taller than the cutting elements of the other type, thus having a greater cutting depth or exposure. In the alternative embodiments of FIGS. 2B and 2C, which, like FIG. 2A, are representative schematic cross-sections of row of mixed cutting elements on a roller cone, taken through the cutter that the row forms on a plane perpendicular to the journal axis of the roller cone, the milled teeth 132 and cemented metal carbide inserts 134 have different heights, as indicated by dashed lines 204 and 206 in FIG. 2B, and by dashed lines 208 and 210 in FIG. 2C. In FIGS. 2A-2C the height of the cutting element is the distance of a line normal to the journal axis (not shown) of the roller cone, from a given point of intersection of the line with the journal to the top of the cutting element. These different heights are intended to represent different cutting depths of the two types of generic cutting elements comprising a particular row on a particular roller cone. In the embodiment of FIG. 2B, the milled teeth 132 are taller than the cemented metal carbide inserts 134. The longer, more aggressive improves the efficiency of a cutter expected to encounter mostly softer composite materials. The shorter cemented metal carbide inserts 134 that are part of this particular row would allow the longer milled teeth to penetrate further into the software material, but still be available to assist with grinding away harder elements of the plug that the cutter might encounter. This particular arrangement might be best suited for an inner row as compared to a heel row.

In the embodiment of FIG. 2C, the cemented metal carbide inserts 134 are taller than the milled teeth 132, and thus have a deeper cutting profile. The shorter teeth are better able to withstand damage from harder material than more aggressive, longer teeth. This arrangement might be better suited for a row, such as a heel row, expected to encounter metal parts for at least a portion of the plug drill out. The cemented metal carbide inserts would be expected to handle most of the work of grinding away the harder, metal elements. The shorter milled teeth, though not as efficient as long teeth, would be better able to survive the milling of the harder, metal parts but be still be available to penetrate softer materials as the bit drills through the plug, thereby improving the overall cutting efficiency of the row.

Turning back to FIG. 1, the cutting elements within each row are aligned, meaning that each cutting elements is located in the same position in the cutting profile (the same radial distance from the centerline of the bit.) However, in the alternative, the positions of the cutting elements within the same row could be staggered. In other words, they do not have to be aligned. For example, within a given row, the positions of cutting elements of a first generic type might be located closer to the heel than the positions of cutting elements of a second type. In another example, the positions of all of the cutting elements of a first generic type could be the same, but the positions of the cutting elements of the second generic type could be staggered so that they alternate between two positions.

Each cutter that is formed from mixed cutting elements types—particularly, milled teeth and cemented metal carbide inserts in these examples—has a pattern of cutting elements in a row around the roller cone, with at least one repetition, that comprises one or more cutting elements of a first type followed by one or more cutting elements of a second type of cutting elements. Each of the rows of mixed cutting element types shown FIGS. 1 and 2A-2C utilize a simple alternating pattern of milled tooth adjacent to one cemented metal carbide insert. However, the cutting elements could be placed in a different, repeating pattern, around the roller cone for one or more of the rows on one or more of the roller cones. For example, the pattern could be two or more milled teeth and then one or more cemented metal carbide inserts; or two or more cemented carbide teeth followed by one more milled teeth. Each pattern would be repeated at least one around the row.

In the illustrated embodiment of FIGS. 1 and 2A-2C, each cutting element of a particular type—milled tooth or cemented carbide insert—in a given row shares the same physical characteristics, such as shape, size (height, depth, etc.) and material composition. For example, the cemented metal carbide inserts in a particular row have the same, to within generally accepted manufacturing tolerances, height, shape, material composition and density. They are, for practical purposes, identical. However, in alternative embodiments of the one or more roller cones comprising a rotary drill bit for milling plugs, one or more characteristics of the cutting elements of the same generic type within the same row can be varied according to a predetermined pattern. For example, the shape, dimensions, density, and/or composition of the inserts made of super hard material within the same row could be varied according to a predetermined pattern. Similarly, inserts of the same generic type—milled teeth and/or inserts made of super hard material—in different rows on the same roller cone need not be identical. For example, inserts used on heel row need not have the same density, shape, dimension and/or composition as inserts used on an inner row. The milled teeth used on heel row could be shorter than the milled teeth on an inner row, and/or the milled teeth on the heel row could be hard faced while the milled teeth on an inner row are not.

The foregoing description is of exemplary and preferred embodiments. The invention, as defined by the appended claims, is not limited to the described embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated or described structures or embodiments.

What is claimed is:

1. A roller cone drill bit comprising:

a body having a central axis, around which it is to be rotated, and a coupling for connecting the body to a drill string or coiled tubing; and at least a first and a second roller cone, each of which is mounted for rotation about a bearing axis extending from the body at an angle oblique to the central axis and has a heel portion and an inner portion between the heal portion and central axis, each of the first and second roller cones having surface on which is disposed a plurality of cutting elements, the plurality of cutting elements arranged on a surface in a plurality of rows comprising at least a first row and a second row that are each concentric with the bearing axis, with one of the first and second rows located closer to the central axis than the other;

wherein the first row on the first roller cone is comprised of groups of one more milled steel teeth alternating with groups of one or more cemented metal carbide inserts, wherein each of cemented carbide inserts has a cutting depth that is equal to or greater than each of the plurality of milled steel teeth in the first row.

2. The roller cone drill bit of claim 1, wherein the cemented metal carbide inserts comprise tungsten carbide.

3. The roller cone drill bit of claim 1, wherein the cemented metal carbide inserts have a deeper cutting depth than the milled teeth in the one of the plurality of rows.

4. The roller cone drill bit of claim 1 wherein the first row is located on a heel portion of the first one of plurality of roller cones.

5. The roller cone drill bit of claim 4, wherein the second row on the first roller comprises milled teeth and no cemented carbide inserts is located on an inner portion of the roller cone.

6. The roller cone drill bit of claim 1, wherein the second row on the first roller cone, is nearer to the central axis of the body than the first row and is comprised of groups of one more milled steel teeth alternating with groups of one or more cemented metal carbide inserts, wherein each of plurality of milled steel teeth in the second row has a cutting depth that is equal to or greater than each of the cemented carbide inserts in the second row.

7. The roller cone drill bit of claim 1, wherein the first row on the second roller-cone is comprised of a group of one or more milled steel teeth alternating with a group of one or more cemented metal carbide inserts, the metal carbide inserts having a cutting depth equal to or greater than the milled steel milled teeth.

8. The roller cone drill bit of claim 1, wherein the second row on the first cone is nearer to the central axis of the body than the first row and is comprised of groups of one more milled steel teeth alternating with groups of one or more cemented metal carbide inserts, and wherein the cemented metal carbide inserts in the first row of cutting elements on the first roller cone has at least one characteristic different from the cemented metal carbide inserts in the second row of cutting elements on the first roller cone, the at least one characteristic being selected form the set of characteristics comprising shape, composition, density, dimensions, and cutting depth.

9. The roller cone drill bit of claim 1, wherein a second row of the plurality of cutting elements extending from the surface of the first one of the plurality of roller cones, nearer to the central axis of the body than the first row, is comprised of groups of one more milled steel teeth alternating with groups of one or more cemented metal carbide inserts, and wherein each of cemented carbide inserts in the second row has a cutting depth that is equal to or greater than each of the milled teeth in the second row.

10. A roller cone drill bit comprising:

a body having a central axis, around which it is to be rotated, and a coupling for connecting the body to a drill string or coiled tubing; and a plurality of roller cones, the plurality of roller cones including a first roller cone and a second roller cone, each of the first and the second roller cones mounted for rotation around a bearing axis extending from the body at an angle oblique to the central axis; the first and the second roller cones each having a surface on which is disposed a plurality of cutting elements, the plurality of cutting elements arranged in at least two rows, the at least two rows comprising a heel row and an inner row, each row being concentric with the bearing axis of the roller cone;

wherein the plurality of cutting elements comprise milled teeth and cemented metal carbide inserts, and wherein the heel row on each of the first and second roller cones is each comprised of groups of one more milled steel teeth alternating with groups of one or more cemented metal carbide inserts and wherein the inner row is comprised of milled teeth without any cemented metal carbide inserts in the inner row; and wherein the cemented metal carbide inserts in the heel row on the at least one of the first and second roller cones have a greater cutting depth than the milled teeth in heel row.

11. The roller cone drill bit of claim 10, wherein the cemented metal carbide inserts comprise tungsten carbide.

12. The roller cone drill bit of claim 10, wherein the milled teeth in the heel row on the first roller cone has at least one characteristic different from the milled teeth in the inner row of cutting elements on the first roller cone, the at least one characteristic being selected form a set of characteristics consisting of shape and cutting depth.

13. A method of milling a plug installed within a well bore, comprising, lowering a roller cone drill bit into the well bore; and rotating the roller cone drill bit while engaging a plug installed within the well bore;

wherein the drill bit comprises:

a body having a central axis, around which it is to be rotated, and a coupling for connecting the body to a drill string or coiled tubing; and a plurality of roller cones comprising at least a first roller cone and a second roller cone, each of which is mounted for rotation about a bearing axis extending from the body at an angle oblique to the central axis, the first roller cone having a surface on which is disposed a plurality of cutting elements arranged in at least a first row and a second row concentric with the bearing axis, one of the first row and second row being closer to the central axis than the other; the first row being comprised of alternating groups of one more milled steel teeth and one or more cemented metal carbide inserts, each of the cemented metal carbide inserts having a cutting depth equal to or greater than each of the milled steel teeth.

14. The method of claim 13, wherein the second row is closer to the central axis than the first row and is comprised of milled teeth and no cemented carbide inserts.

15. The method of claim 13, wherein the second row is closer to the central axis than the first row is comprised of alternating groups of one more milled steel teeth and one or more cemented metal carbide inserts, each of the milled teeth having a deeper cutting depth than each of the metal carbide inserts.

16. The method of claim 13, wherein the first row is located on a heel portion of the first cone.

17. The method of claim 13, wherein the second roller cone comprises a surface on which is disposed at least a first row and a second row of cutting elements concentric with its bearing axis the first row on the second roller cone being located on the heel of the roller cone and comprising milled teeth and cemented metal carbide inserts, and a second row on the second roller cone being located closer to the central axis and comprised of a group of one or more milled steel teeth alternating with a group of one or more cemented metal carbide inserts.

18. The roller cone drill bit of claim 13, wherein the second row is comprised of groups of one or more milled steel teeth alternating with groups of one or more cemented metal carbide inserts, the cemented metal carbide inserts in the first row has at least one characteristic different from the cemented metal carbide inserts in the second row of cutting elements on the first roller cone, the at least one characteristic being selected form the set of characteristics comprising shape, composition, density, dimensions, and cutting depth.

* * * * *